US005490785A

United States Patent [19]

Hein et al.

[11] Patent Number: 5,490,785

[45] Date of Patent: Feb. 13, 1996

[54] AUTOMOTIVE SPLICE CONNECTOR

[75] Inventors: David A. Hein, Sterling Heights; Robert S. Migrin, Livonia, both of Mich.

[73] Assignee: Alcoa Fujikura Limited, Brentwood, Tenn.

[21] Appl. No.: 330,917

[22] Filed: Oct. 28, 1994

[51] Int. Cl.[6] ..... H01R 9/24

[52] U.S. Cl. ..... 439/76.1; 439/587; 439/620; 439/721

[58] Field of Search ..... 439/189, 507, 439/510–512, 721, 723, 724, 76, 260, 271, 274, 275, 587, 589

[56] References Cited

U.S. PATENT DOCUMENTS 3,397,384 8/1968 Lawrence ..... 439/721

*Primary Examiner*—Gary F. Paumen

*Attorney, Agent, or Firm*—Elroy Strickland

[57] ABSTRACT

A water-tight splice connector made from an existing connector, including a first housing and a plurality of pins mounted in means for splicing the pins together located in the housing. A first seal member is located at one end of the housing behind the splicing means and pins. A retainer member engages the housing behind the seal member to protect and secure the seal member in place in the housing. A terminal locking member is insertable in the end of the housing opposite the end receiving seal member to lock and align the pins in place within the housing. A second seal member is located in a second housing containing female terminals for receiving the pins in the first housing. An interfacial seal member is located between the first housing and second housing to seal both housings from outside moisture and water. In the case where the first and second housings are used to connect the wires of two harnesses together, the splicing means is made smaller to permit the wires to bypass the splicing means.

8 Claims, 5 Drawing Sheets

AUTOMOTIVE SPLICE CONNECTOR

BACKGROUND OF THE INVENTION

Figure 1:
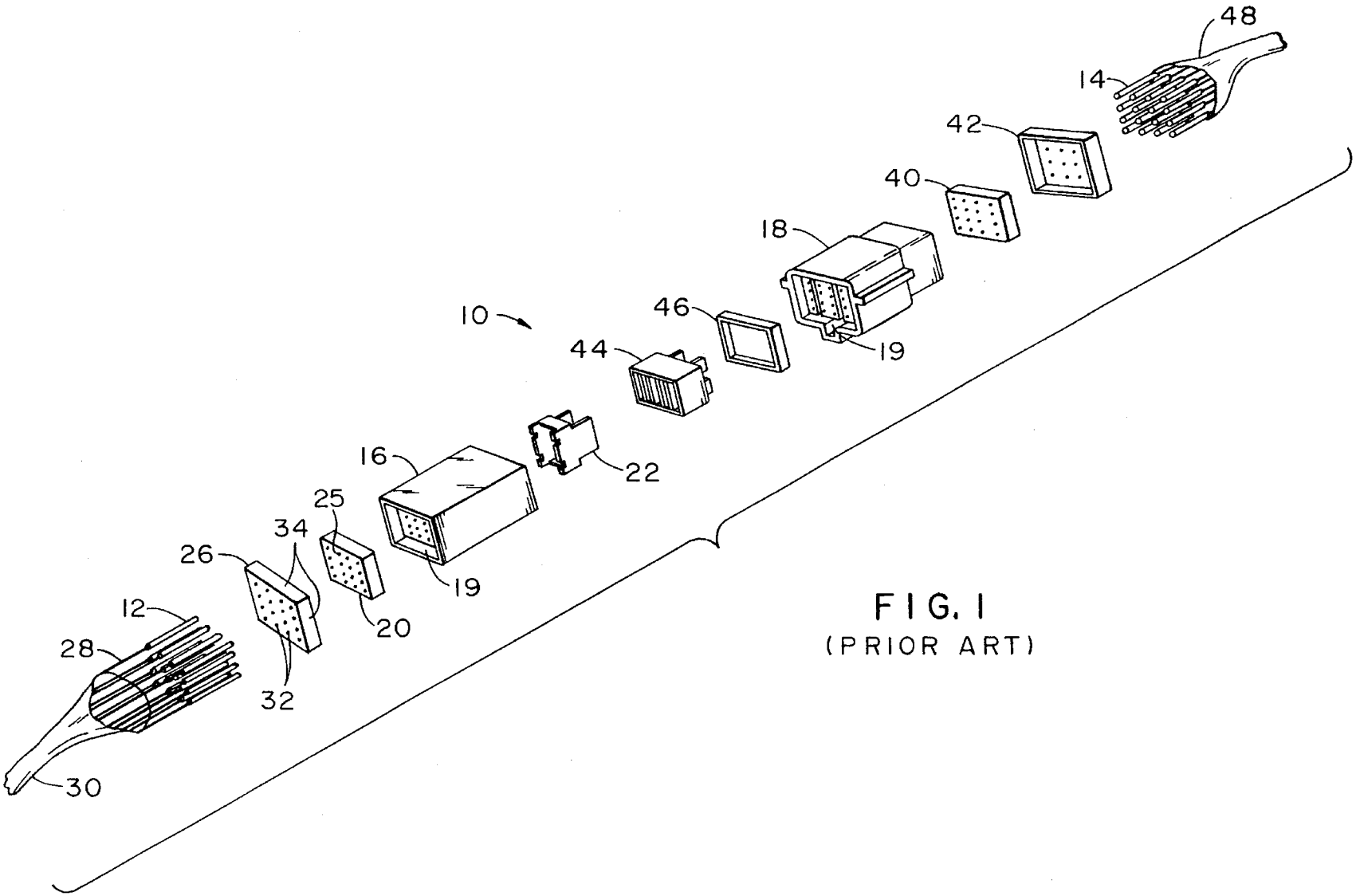
FIG. 1 (PRIOR ART)

The present invention relates to connectors for splicing together circuits in motor vehicles and in wire harnesses for motor vehicles. A splice is used when more than one device requires the same electrical signal or potential.

The typical method nowadays for making electrical splices in a vehicle involves the welding of individual wires to each other within the bundle of a wire harness. Splices are covered with various sealing means including heat shrink tubing and electrical tape in attempts to protect the splices from environmental conditions outside of the splice. In harsh environments, the sealing methods have been found to be ineffective, as moisture can work and wick its way through such tubing and electrical tape to the location of the weld thereby causing corrosion and eventual interruption of the circuit at the location of the weld.

One method to replace welded splices employs custom design blade connectors that mate to a "splice cap". The splice cap contains a bus bar that interconnects the wires connected to the blades of the connector. Another means for making splices includes custom designed junction boxes that contain internal layers of metal. These metal layers are used to interconnect (splice together) desired wires. Custom designed connectors and junction boxes, however, are costly, particularly when compared to a simple welded splice.

Solder splices are not generally used because of the fluxes that are required to make a soldered joint, i.e., a welded joint is simpler and cleaner.

Unsealed, multi-pin splice connectors have also been used by certain automobile manufacturers to electrically connect wires together. However, because these connectors are unsealed, they tend to suffer from the same corrosion problems as welded splices.

SUMMARY OF THE INVENTION

The present invention uses existing micro-pin connector systems that are employed in the automobile industry. These devices use low-cost, molded plastic housings and related parts that can be sealed to prevent ingress of moisture and water into the housings of the connector system. They are used to connect together wire harnesses, for example.

The present invention includes a simple splice device mounted within such connector housings, the splice device joining together the multiple pins of the system to provide the pins with a common electrical connection. The splice device can be simply a metal stamping or plate, i.e., a splice board, provided with multiple openings to receive and mount the multiple pins. The pins can be secured in the openings by any suitable connection technique to provide the common connection between the pins. Or, if the wires and circuits of a harness require multiple splices, multiple stampings or buses can be provided within the connector housing to connect together the respective circuits.

Another means of the invention to provide a common connection or connections is a printed circuitboard. If the circuitboard provides more than one splice for a wire harness, resistors, diodes and/or capacitors can be electrically connected across the individual splices to provide suppression of electrical noise and transient voltages. This locates such electronic components close to the loads, which results in better suppression of noise. Incorporating electronic components on a splice board eliminates the necessity of two welded connections per electronic component, one weld for each terminal of the component to connect the component in wire. The noise suppression components of the invention can be easily included on the surface of the circuitboard and be located between rows of terminal ends secured in the board.

If a harness has less wires than the number of terminals provided in the connector system, additional room is thereby provided for noise suppressing components.

In general, loads generate electrical noise, i.e., DC motors produce commutator pulses, and air conditioner compressor clutches produce inductive transients. A diode is usually connected across an electrically activated air compressor clutch to suppress such transients. In the present invention, the splice can be located close to the noise generator to reduce noise radiated by the generator since the micro-pin systems and connectors can be located close to the noise generator.

If wires need to pass from one wire harness to another, the splicing device of the invention can be reduced in size such that the cavities in the connector housing that ordinarily receive pins, can be used for inserting terminated wires.

The splice connector can also perform the dual function of harness interconnection and wire splicing. Again, pan of the cavities within the connector housing can be used for splicing and the remaining cavities for harness interconnection.

THE DRAWINGS

Figure 2:
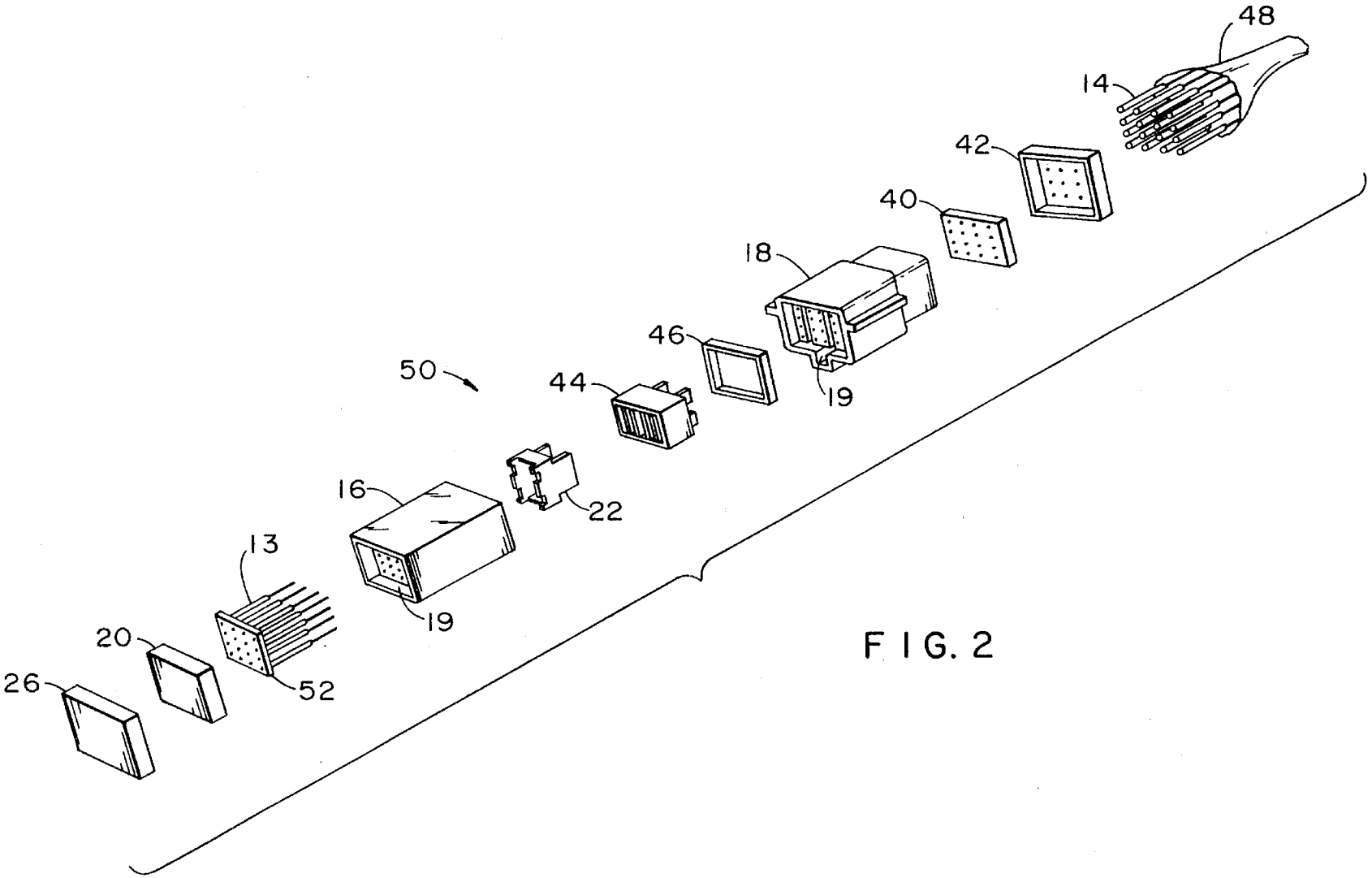
Figure 3:
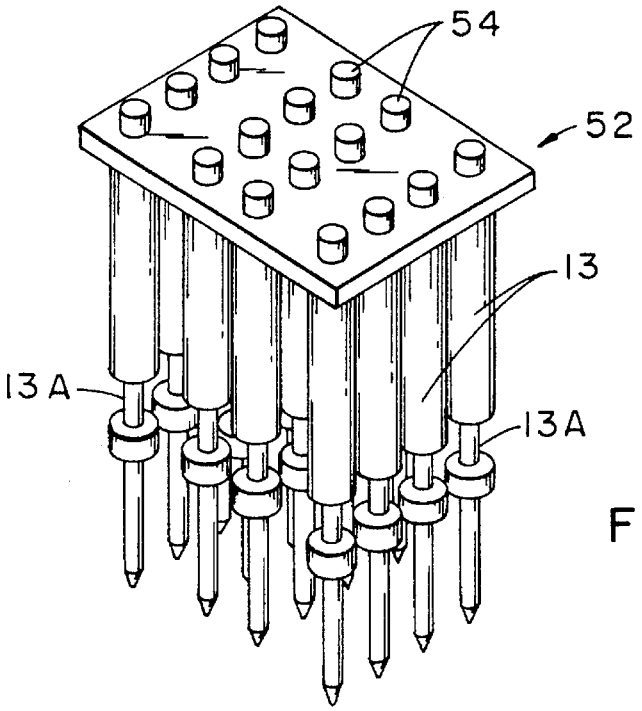
Figure 4:
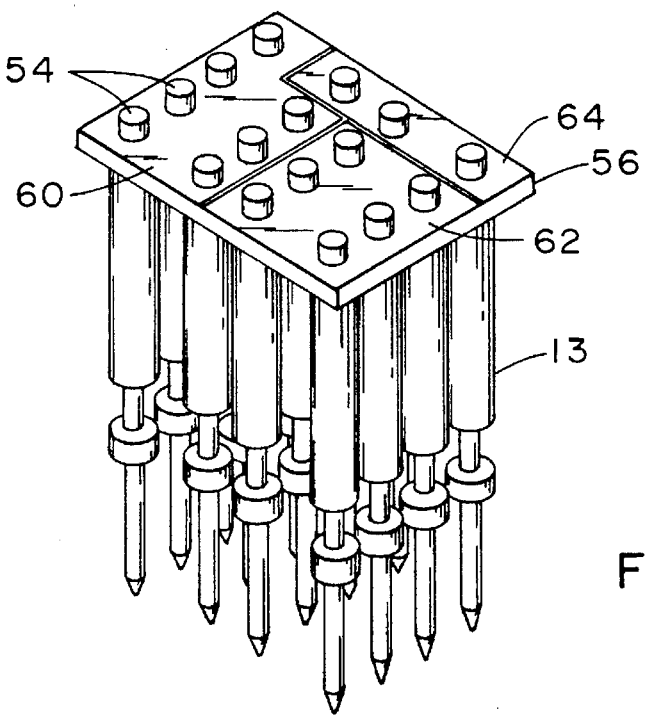
Figure 5:
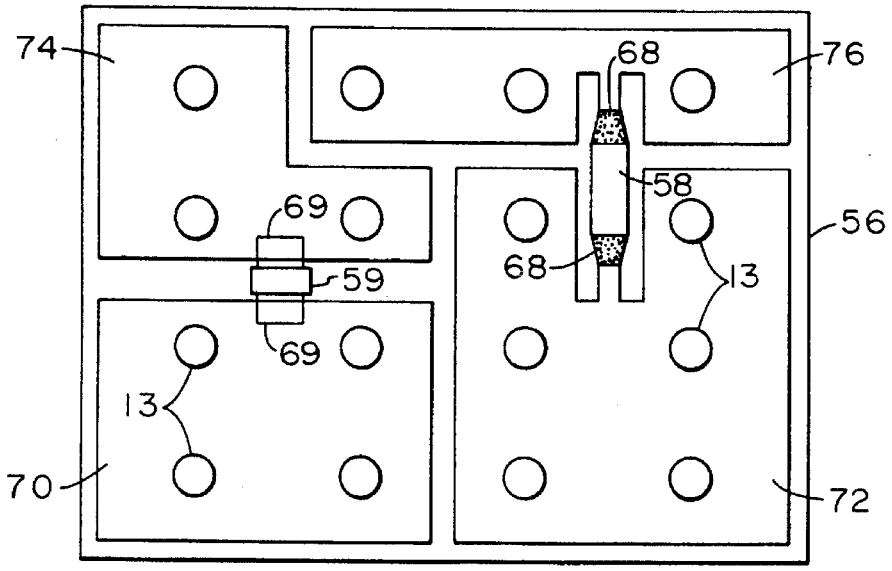
Figure 6:
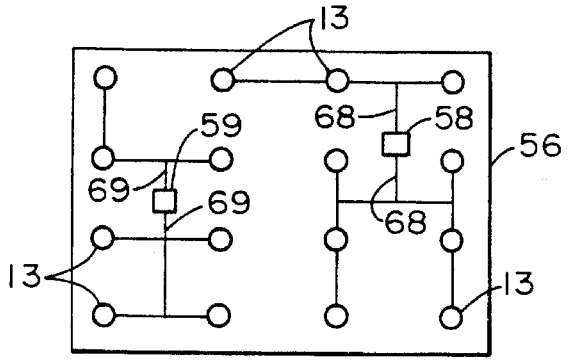
Figure 7:
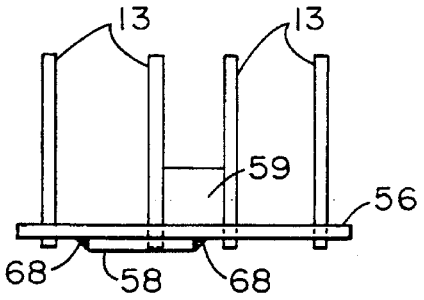
Figure 8:
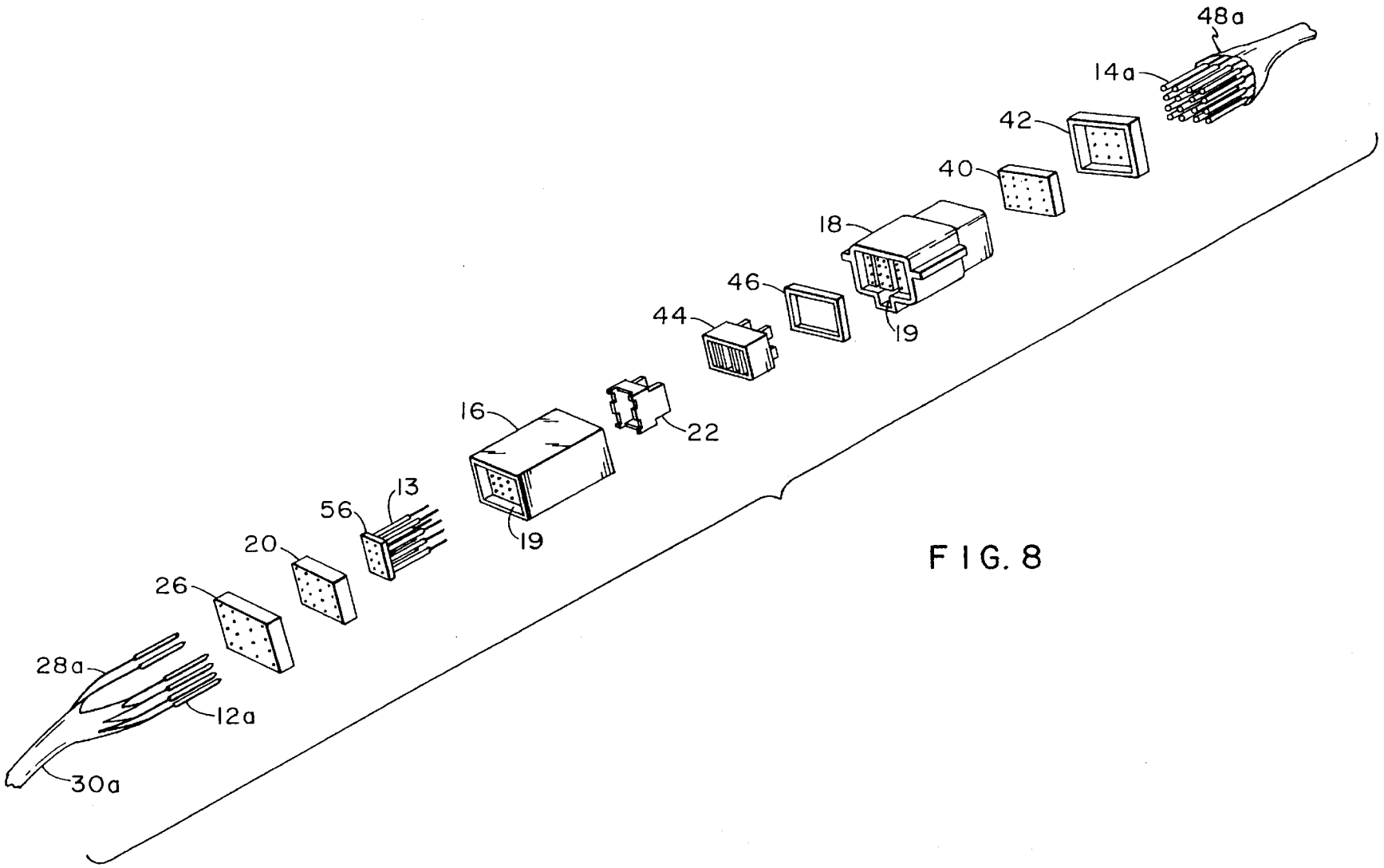

The invention, along with its objectives and advantages, will be better understood from consideration of the following detailed description and the accompanying drawings in which:

FIG. 1 is an exploded view of an existing micro-pin connection system,

FIG. 2 is an exploded view of the same system except that the male connection portion of the system is provided with a splice board that connects together the pins of the micro-pin connector system, FIG. 3 is an enlarged, perspective view of the splice board and pins of FIG. 2, FIG. 4 is a perspective view of a splicing device of the invention in which the splice board is a printed circuitboard having three separated areas for making three splices, FIG. 5 is a plan view of the solder side of a splice board having a first electronic component surface mounted on the solder side surface of the board, FIG. 6 is a schematic representation of the solder side view of FIG. 5, FIG. 7 is a side elevation view of the splice board of FIG. 5 showing the surface mounted component and a second component, with leads mounted on the upper surface of the board, and FIG. 8 is an exploded view of a micro-pin connector system in which the splice means of the invention is of a reduced size to permit direct connection of harness wires.

PREFERRED EMBODIMENTS

Referring now to FIG. 1 of the drawings, an existing micro-pin system 10 is shown in an exploded view, the system having round male pins 12 and small female socket terminals 14, the pins and socket terminals being contained in relatively small packages, i.e., housings 16 and 18, the overall size of which is on the order of three inches long, one and a quarter inches wide and one inch thick. Such systems and assemblies are manufactured by a variety of manufacturers and suppliers to the auto industry, and are made with different numbers of terminals. The invention, however, is not limited to such systems. Other low-cost connector systems can be used for the purposes of the present invention.

Housings 16 and 18 contain cavities 19, visible in FIGS. 1, 2 and 8, that receive the respective pins and terminals.

The "male" side of system 10, in addition to pins 12 and housing 16, includes a seal member or gasket 20 and a locking member 22. The seal member is made of a water repellent elastomer material that seals the interior of housing 16 from the environment outside of the housing when member 20 is inserted into the end of housing receiving pins 12 (see FIG. 1), while locking member 22 aligns and locks pins 12 in place in housing 16.

Connector pins can be locked into place in a variety of ways. In the case of spliced pins 13, as best seen in FIG. 3 of the drawings, and as discussed below, each pin has an indentation or narrow portion 13 A that can receive a ledge (not visible in the figures) integrally provided within cavities 19 of the housing that seats into indentations 13A when the pins are inserted into the cavities. Member 22 provides a secondary lock that prevents the plastic ledge from moving after the pin is inserted into cavity 19.

Seal member 20 is also provided with openings (25) through which pins 12 pass when the components of the male side 12 of system 10 are assembled together. The size of member 20 and size of openings 25 are such that 20 fits snugly within the walls of housing 16 and tightly around the pins to provide the necessary seal.

Seal member 20 is secured in place in the one end of housing 16 and is generally protected by a retaining member 26 that also provides strain relief for the seal member.

Individual wires 28 of a harness 30 are connected respectively to individual pins 12, as seen in FIG. 1, and extend through respective openings 32 provided in retaining member 26.

As shown further in FIG. 1, retaining member 26 is provided with integral lateral walls 34 that slip over the one end of housing 16 and lock on the housing end by interengaging tabs and ledges (not shown) formed integrally on mating surfaces of the two members. Other means, however, can be used to secure 16 and 26 together, such as ultrasonic welding or gluing.

The female side of system 10 comprises components similar to those described above in connection with the male side, i.e., the female side includes the pin receiving sockets 14, a seal member 40, a retainer and strain relief member 42 and a locking member 44. The latter three components function in essentially the same manner as 20, 22 and 26 described above in connection with the male side of system 10.

An interfacial gasket 46 is provided to seal the abutting ends of the two connector housings 16 and 18 from the atmosphere outside of the housings when the housings are brought together to serially connect the wires of harness 30 to the wires of a second harness 48.

FIG. 2 of the drawings shows the basic connector assembly of FIG. 1 convened into a low-cost, sealed splice assembly 50 of the invention, the components in FIG. 2 that are the same as those in FIG. 1 bearing the same reference numerals. Seal member 20 in FIG. 2, however, may be slightly smaller than the one in FIG. 1 so as to accommodate the splice device (52) of the invention and any electronic components that may be mounted on the splice device, as discussed hereinafter.

The splice of the invention can be provided by a simple metal plate or board 52 that structurally and electrically connects a plurality of male pins 13 together and is sized to fit within housing 16. When the terminals 14 of harness 48 are inserted into contact and connection with pins 13 that are spliced together by board 52, the wires of the harness are thereby electrically spliced (connected) together. When the connector housings 16 and 18 are placed together against gasket 46, after being respectively assembled using seal members 20 and 40, the splice within housing 16 is sealed against the environment existing outside of the housings, thereby ensuring a long life for the splices provided by 52, as they are protected against the ingress of water and moisture and thus against corrosion and eventual failure by seal members 20, 40 and 46.

Splice board 52 can be a simple metal stamping of good electrical conductivity provided with openings sized to the cross section of ends 54 (FIG. 3) of pins 13 located in board 52. After the pin ends are inserted into the openings, they are welded or soldered to the stamping.

Other means for splicing terminals 13 together can be a bus or bus strips (not shown) if more than one splice is needed, or the printed circuitboard 56 shown in FIG. 4. As shown in FIG. 4, there are three splices or splice circuit areas provided by three conductive surfaces 60, 62 and 64 printed on an insulating substrate, the three areas electrically joining together the pins 13 of three subgroups of pins.

Again, in each case (using a solid metal plate, buses, or a printed circuitboard), the splice effected in the present invention is sealed from the environment outside of housings 16 and 18 by seals 20, 40 and 46.

The sealing provided by the invention is also effective for any electronic components electrically connected between the separate splice areas 60, 62 and 64. As discussed earlier, noise and transient voltages are suppressed by tiny diodes, resistors and/or capacitors electrically connected in and to harness wires. In the present invention, such components are provided integrally as surface mounted devices on board 56, as indicated by numerals 58 and 59 in FIGS. 5 through 7. FIG. 5 is a plan view of the solder side of board 56 showing a leadless electronic component 58 physically mounted on the solder side surface and directly electrically connected to and between conductive surface 72 and a conductive area and surface 76 by solder fillets 68. Solder flows and extends between the conductive surfaces and terminal ends of 58, as best seen in FIG. 7.

FIGS. 5 through 7 show, in addition, a second electronic component 59 having two leads 69 connected, respectively, to conductive surfaces 70 and 74.

Component 58 can be a resistor, diode, capacitor or fuse. For noise suppression, the component would be a diode.

Component 59 can be a resistor, diode, capacitor or a polyswitch. A polyswitch is a resettable circuit breaker made of positive temperature coefficient (PTC) material. The PTC functions as a fuse when current flow to a load increases to a level that the PTC material heats and trips. This reduces current flow such that the heat of the material reduces to restore current to the load.

Component 58 and the base ends 54 of pins 13 can be soldered to the solder side of conductive surfaces 70, 72, 74 and 76 in a single operation in which molten solder is applied to the board 56. In such a case, a mask (not shown) is placed on the solder side of the board to keep solder material from the conductive surface areas. Such a mask has openings for receiving terminal ends 54 and fillet areas 68 so that solder can flow into such openings and thus around ends 54 and fill in the areas adjacent the ends of component 58 to form fillets 68.

If a harness 30*a* (FIG. 8) has one or more unspliced wires 28*a* with terminal pins 12*a* that must bypass the splice of the invention to connect directly with female terminals 14*a* of a second harness 48*a*, the splice board 56 of the invention can be smaller, with less pins, as shown in FIG. 8 of the drawings. This provides space in connector housing 16 to allow pins 12*a* to pass the board in the process of being received directly in terminals 14*a*. Again, this is a low-cost solution, as system 50 employs low-cost sealed systems that are already available.

What is claimed is:

1. A water-tight splice connector, comprising a first housing having opposed ends, a plurality of pins mounted in a circuitboard which electrically connects the pins together, said circuitboard being fitted within one end of said housing, a seal member located in one end of said housing and behind said circuitboard and pins, said seal member assisting in sealing the interior of the housing from outside moisture, a retainer member located at the one end of said housing and seated behind said seal member to secure the seal member in place in said housing, and a terminal locking member located in the other end of the housing that locks and aligns the pins in place within the housing.

2. The splice connector of claim 1 in which the circuitboard has a conductive pattern that provides separate circuit areas on the circuitboard, and noise suppressing components mounted on the board and electrically connected between the separate circuit areas.

3. The splice connector of claim 1 in which the plurality of pins terminate a like plurality of harness wires for use in a motor vehicle.

4. The splice connector of claim 2 including a second housing containing a plurality of terminals for connecting with the plurality of pins in the first housing.

5. A method of converting an existing, sealed, multi-pin connector to a multi-pin splice connector, comprising:

removing a retaining member from one end of a connector housing containing a plurality of pin terminals located in a plurality of pin receiving cavities provided within the housings, removing a seal member from the one end of the housing, using a splicing device to splice together the plurality of pin terminals, locating said splicing device in the one end of the housing and the pin terminals in the cavities of the housing, and locating said seal member in the one end of said housing and behind the splicing device to assist in sealing the interior of the housing against the environment existing outside of the housing;

wherein a portion of the cavities in the connector housing receive terminated wires, and the remaining cavities receive pins mounted in the splicing device.

6. The method of claim 5 including:

inserting a locking member into the housing at the end thereof opposite the end receiving the seal member to lock and align the pin terminals in place in the housing.

7. The method of claim 5 including:

attaching said retaining member to the end of the housing receiving the seal member to protect and secure the seal member in place in the housing.

8. The method of claim 5 in which a second multi-terminal connector housing has a seal member and pin receiving socket terminals that terminate the respective ends of the wires of a wire harness, the method including:

locating an interfacial seal member between the two connector housings, and placing the two connector housings together such that the wires of the harness are joined together by the splicing device and sealed against the atmosphere outside of the connector housings by all of the seal members.

* * * * *